US005509400A

United States Patent [19]

Chalin

[11] Patent Number: 5,509,400

[45] Date of Patent: Apr. 23, 1996

[54] BOW ARM SUPPORT STABILIZER SYSTEM

[76] Inventor: Manuel L. Chalin, 64 Evergreen Dr., Kincholoe, Mich. 49799

[21] Appl. No.: 127,549

[22] Filed: Sep. 28, 1993

[51] Int. Cl.[6] ..... F41B 5/14

[52] U.S. Cl. ..... 124/86; 124/88

[58] Field of Search ..... 124/86, 88, 89, 124/23.1, 24.1, 25.6; 248/118, 118.3; 42/94

[56] References Cited

U.S. PATENT DOCUMENTS

| | | | |
|---|---|---|---|
| 1,564,089 | 12/1925 | Maxwell . | |
| 3,256,872 | 6/1966 | Koser . | |
| 3,814,075 | 6/1974 | Hoyt, Jr. . | |
| 4,290,407 | 9/1981 | Damron | 124/88 X |
| 4,360,179 | 11/1982 | Roberts . | |
| 4,393,614 | 7/1983 | Pickett | 42/94 |
| 4,491,123 | 1/1985 | Wirtz . | |
| 4,553,522 | 11/1985 | Topping . | |
| 4,674,472 | 6/1987 | Reis . | |
| 4,846,140 | 7/1989 | DiMartino | 124/86 X |
| 4,993,398 | 2/1991 | Wallace . | |
| 5,106,044 | 4/1992 | Regard, III et al. . | |
| 5,205,268 | 4/1993 | Savage | 124/88 X |
| 5,205,272 | 4/1993 | Boyer | 124/89 |
| 5,240,211 | 8/1993 | Anderson | 243/125 |
| 5,320,085 | 6/1994 | Hanneman | 124/89 |
| 5,345,706 | 9/1994 | Brown | 42/94 |
| 5,351,867 | 10/1994 | Vest | 124/89 X |

OTHER PUBLICATIONS

Petersen's Hunting, Feb. 1992, "Clothing and Gear Tested in the Field" p. 10, and Steady Your Hold, pp. 24 and 25.

Bowhunters Discount Warehouse, Inc. catalog, Summer Edition, 1992, p. 96.

*Primary Examiner*—Brian K. Green
*Assistant Examiner*—Harry C. Kim
*Attorney, Agent, or Firm*—Lowe, Price, LeBlanc & Becker

[57] ABSTRACT

A bow arm support stabilizer system for supporting the weight of the bow while aiming and shooting is disclosed. The system has a horizontal connecting shaft with a rear end pinned to the riser section of the bow beneath an intermediate hand grip portion thereof. A pair of closely vertically spaced pins projecting forwardly from the forward facing edge of the riser section are received in corresponding axial bores formed in the shaft rear end to provide a non-rotational connection. A strap may be used to connect the shaft rear end to the riser section. A telescopic support rod assembly is pivotally mounted to the front end of the horizontal shaft. The lower end of the support rod assembly is provided with a rubber cap adapted to frictionally engage the top of the archer's shoe to support the bow through the support rod assembly and the horizontal shaft. The non-rotational connection prevents relative twisting movement between the bow and the shaft as a result of high torque at these points of connection generated by the moment arm effect of the support rod assembly relative to the ground.

19 Claims, 6 Drawing Sheets

BOW ARM SUPPORT STABILIZER SYSTEM

TECHNICAL FIELD

The present invention relates generally to archery and, more particularly, to a stabilizing system for supporting a bow during aiming and shooting so that the weight of the bow is not borne solely by the extended bow arm of the archer.

BACKGROUND ART

With the advent of new carbon fiber and composite technologies, the demands by archers for precision arrows and equipment for shooting accurately has been steadily increasing. Indeed, to be successful in archery, each shot has to be almost identical to the previous one. To achieve this objective, archers go to great lengths to use a matched set of arrows wherein the lengths of these arrows are cut with precision and a spacing of the fletching and the positioning of the nocks are all exacting. To obtain a matched set, the weight of the heads are measured in micrograms. There now exists equipment to measure the straightness of the nocks to within 0.001". Broad heads are also checked to the same tolerance with equipment sold for that purpose. There are arrow straighteners with built in micrometers, and washers that weigh one grain which will fit between the shaft and the head to provide proper weight and balance. There are also special bow squares that connect to the string so that the bow nocks can be set precisely.

The list of activities and equipment to improve accuracy in modern archery is almost endless. Other examples include, and are not limited to, bow stabilizers, mechanical releases, varied sights, bow cases to protect the equipment along with arrow cases and quivers, range finders and leveling devices, to name but a few. The foregoing list does not even consider hunting aids.

Notwithstanding the advancements made in archery equipment, the major problem which archers typically have relates to the inability to keep their bow arm extended while aiming without inducing quivering within the arm. Considering the pull force being exerted when the bow string is fully drawn, it is difficult for almost any archer to maintain their bow arm absolutely steady while aiming and shooting. Although the use of compound bows tends to minimize the pulling force exerted on the bow string during aiming and shooting, the actual weight of compound, recurved and tournament bows fatigues the bow arm and further induces quivering.

It is accordingly one object of the present invention to minimize quivering of an archer's extended bow arm while aiming and shooting to improve accuracy of the shot.

Another object is to provide a new mechanism which is easily attachable to an archery bow without necessarily requiring tools and which is adjustable to engage a supporting surface to support the weight of the bow while aiming and shooting.

Still a further object is to easily retrofit existing bows to facilitate mounting of the new stabilizing and bow supporting equipment.

DISCLOSURE OF THE INVENTION

A bow arm support stabilizer system for supporting an archer's bow relative to a support point external to the archer, in accordance with the present invention, comprises a bow connecting arm assembly connected to project forwardly from a riser of the bow, and a support rod assembly connected to project downwardly from the bow connecting arm assembly so that a lower end of the support rod assembly is engageable with the external support point. The connecting arm assembly and support rod assembly cooperate with each other to transfer the weight of the bow to the external support point so that the archer's extended bow arm does not have to support the bow's weight during aiming and shooting. This greatly reduces quivering of the archer's arm to improve accuracy in shooting.

In accordance with the preferred embodiment, the bow connecting arm assembly preferably includes a connecting shaft secured at a rear end thereof to the riser section. The support rod assembly preferably includes a pivot link secured to the connecting shaft such that the plane defined between the connecting shaft and support rod assembly is coplanar with the plane of the bow. By further securing the connecting shaft to the riser section of the bow with at least two pins, relative rotation between the shaft and the riser section is prevented to advantageously avoid twisting of the bow during aiming and shooting.

The connection between the shaft and riser may be further constructed to minimize shaft rotation through the use of a strap with a self-locking buckle engageable with the shaft and the bow. The strap is wrapped one or more turns around the handle and shaft to impart a tightening force urging the shaft towards the handle. In the preferred embodiment, the rear end face of the shaft is preferably formed with a pair of bores respectively receiving forwardly projecting ends of the pins. The pins may be of different diameter, wherein the larger diameter pin has a threaded end received in a threaded bore in the riser section. In this embodiment, the threaded bore formed in the riser section is conventionally formed with a substantially circular flat face formed in a forward facing edge of the riser section and below an intermediate hand grip portion thereof. The rear end face of the shaft is adapted to abut against this circular flat face and is of sufficient diameter to further receive the second pin which may be a smaller diameter and located in an unthreaded bore located immediately below the threaded bore.

The connecting shaft may further include a transverse through bore through which the strap extends to transmit the tightening wrapping force from the riser to the shaft.

The shaft may also include a vertically extending through slot extending longitudinally through a forward portion of the shaft. A pivot link is pinned to the shaft within the slot and the support rod assembly is attached to the pivot link.

The connecting shaft may be further formed with a threaded bore in a forward end thereof which is adapted to receive a game tracker in threaded engagement therewith. The support rod assembly preferably includes at least a pair of rods telescopically connected to each other. A locking ring may be used to lock the rods together after the overall support rod has been extended to a predetermined effective length. A rubber cap is preferably mounted to the lower end of the support rod assembly. The rubber cap is engageable with the top of an archer's shoe to support the weight of the bow.

A method of supporting an archer's bow during aiming and shooting is also disclosed. The method comprises the steps of attaching a bow connecting arm assembly to the bow riser so that it projects forwardly from the bow. A support rod assembly is connected to project downwardly from the bow connecting arm to engage a support surface at a lower end thereof. The archer's bow arm is then extended for aiming and shooting the bow and, during such extension, the weight of the bow is advantageously supported by the support rod assembly engaging the support surface.

Compound, conventional or tournament and take down bows are commonly formed with a single threaded blind bore in a forward facing edge of the riser section, immediately below an intermediate hand grip portion thereof. Therefore, in accordance with a further feature of the invention, a kit for retrofitting this type of bow comprises a drill block having a pair of vertically spaced through bores, with the upper through bore adapted to receive a threaded bolt which threadedly engages the blind bore to temporarily mount the block to the handle section. The lower through bore acts as a pilot or guide hole and is adapted to receive a drill bit of predetermined cross section which may be marked so that an untapped blind bore of predetermined depth is formed in the handle section of the bow vertically below the threaded blind bore. The drill block is then removed from the bow and the connecting shaft of the invention is then mounted to the handle section of the bow with two pins projecting from the rear end face of the shaft. In this manner, the shaft is prevented from rotating about its axis and relative to the plane of the bow. This maintains the support rod assembly coplanar with the plane of the bow.

The above and still further objects, features and advantages of the present invention will become apparent upon consideration of the following detailed description of a specific embodiment thereof, especially when taken in conjunction with the accompanying drawings.

BEST MODE FOR CARRYING OUT THE INVENTION

Figure 1:
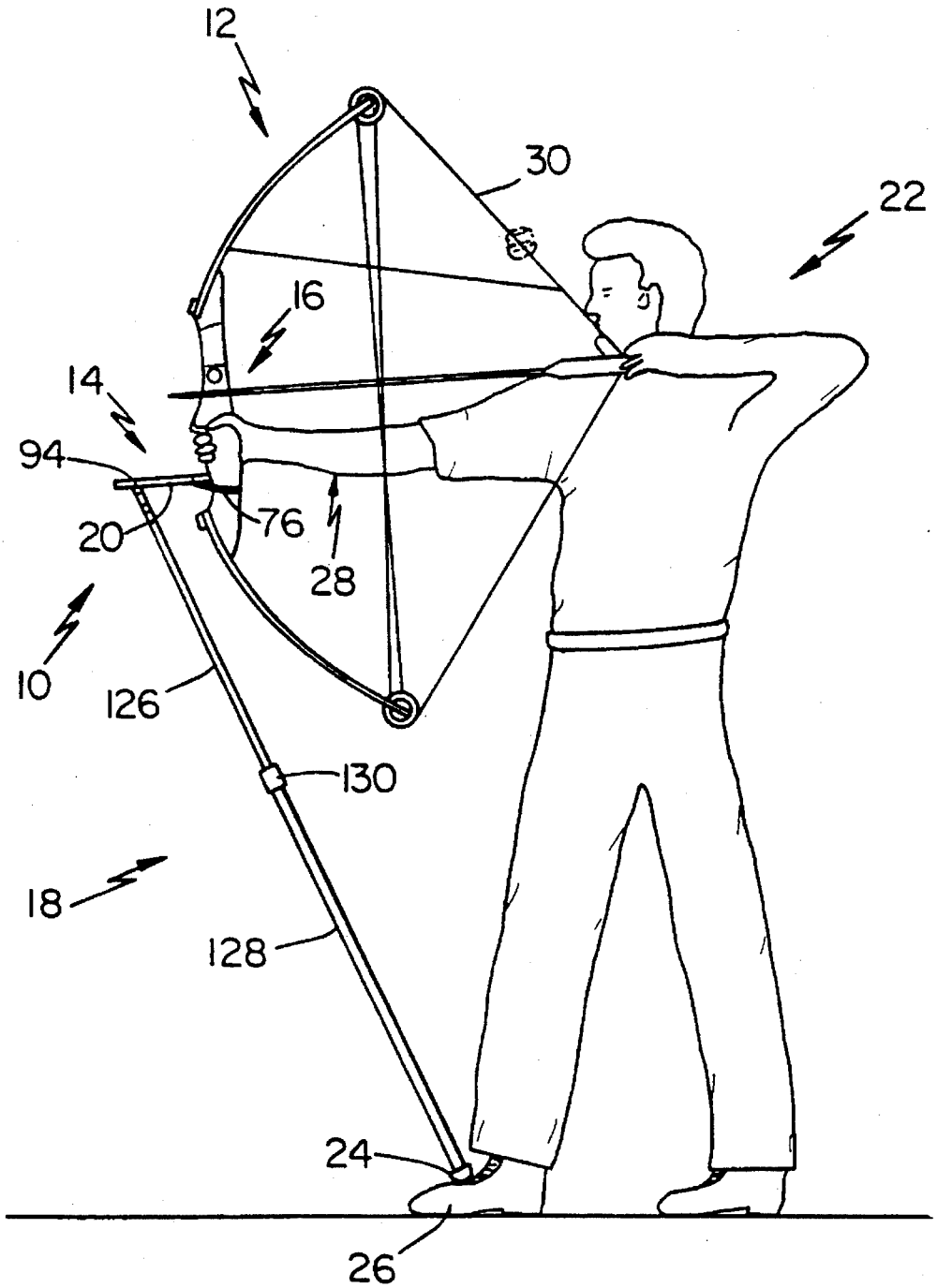
FIG. 1 is a perspective view of the bow arm support stabilizer system during operational use while an archer is aiming the bow.

Referring to FIG. 1, the bow arm support stabilizer system 10 of the present invention is utilized to substantially entirely support the weight of the archer's bow 12 during aiming and generally comprises a bow connecting arm assembly 14 mounted to project forwardly from the bow riser section 16 for pivotal connection to a support rod assembly 18 projecting downwardly from the bow connecting arm 20. The support rod assembly 18 is of sufficient length and appropriately angled (e.g., at an angle of about 20°–22° from the vertical, towards the archer 22) so that the lower end with rubber cap 24 thereof can rest upon a support surface (e.g., the top of the archer's shoe 26) to support the weight of the bow 12 and thereby eliminate quivering of the archer's extended bow arm 28 while aiming. In accordance with other unique features described more fully below, the bow connecting arm assembly 14 is securely and non-rotationally connected to the riser section 16 so that the bow 12 cannot rotate or move relative to the arm assembly 14 which would otherwise adversely effect aiming. By maintaining the connection between the arm assembly 14 and the riser section 16 as a rigid and non-rotational connection during aiming, the plane formed by the bow 12 and drawstring 30 is coplanar with the plane formed between the bow connecting arm 14 and support rod assembly 18.

Figure 2:
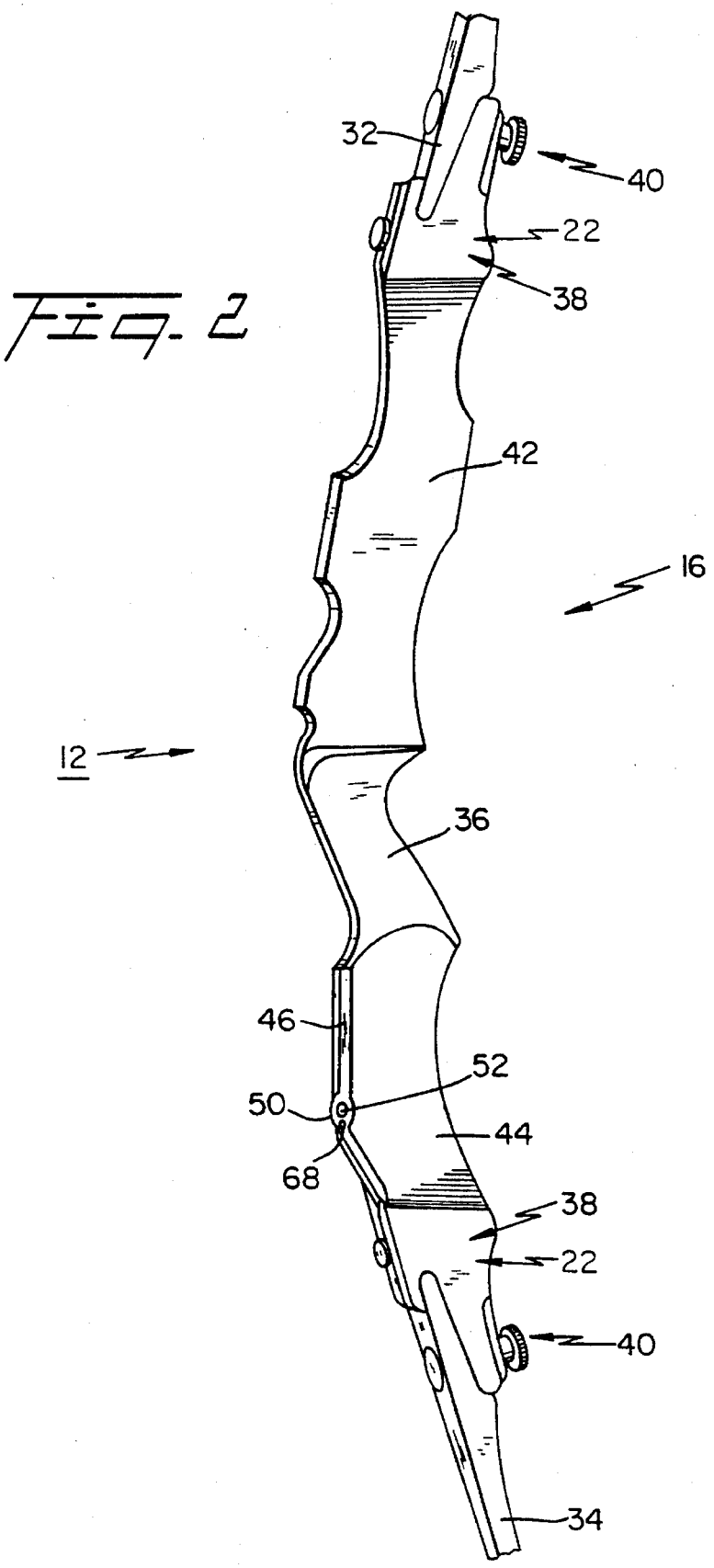
FIG. 2 is an enlarged fragmentary side elevational view of the bow depicted in FIG. 1.

Referring to FIG. 2, the bow comprises a cast or machined metal handle or riser section 16, an upper limb 32, a lower limb 34, a bowstring 30 (FIG. 1), and may also be provided with one or more stabilizers (not shown) one of which may advantageously be secured to a threaded bore formed in the front end of the bow connecting arm assembly (not shown in detail). The riser section 16 has an intermediate hand grip portion 36 and upper and lower portions 38 carrying bow limb receiving brackets 40. An upper riser section 42 extending between the intermediate hand grip portion 36 and the upper end portion 38 of the riser section is adapted to carry a sight (not shown) as is well known. The lower riser section 44 extending between the intermediate hand grip portion 36 and the lower end portion 40 of the riser section is conventionally formed with a profiled front facing elongate edge 46 extending between the lower end portion 38 and the intermediate hand grip portion 36. This edge 46 is continuous with the front facing edge of the intermediate hand grip portion 36. Immediately below the intermediate hand grip portion, this edge 46 is formed with a preferably flat circular surface 50 containing a threaded blind bore or stabilizer port 52 which is normally adapted to receive the threaded portion of a stabilizer (not shown) but may instead advantageously receive the threaded portion 54 of a first connecting pin 56 (FIG. 3D) having an unthreaded forward end 58 projecting forwardly from the riser section a short distance to be received within a smooth axial blind bore 60 formed in the rear end of a bow connecting shaft 62 (FIG. 3A) of the arm assembly 14. To prevent rotation of the shaft 62 about the first connecting pin 56, a second pin 64 (preferably unthreaded along its length), FIG. 3E, has a forward end received in an unthreaded bore 66 also formed in the rear end of the shaft 62 vertically beneath and parallel to the first bore 60. A rearwardly projecting portion of this second pin 64 is received in an unthreaded blind bore 68 formed vertically beneath and parallel to the threaded bore 52 in the forward facing front edge 50 of below the hand grip portion so that the at least two pinned connections prevent the undesirable aforesaid rotation from occurring as will be discussed in more detail below.

Figure 3B:
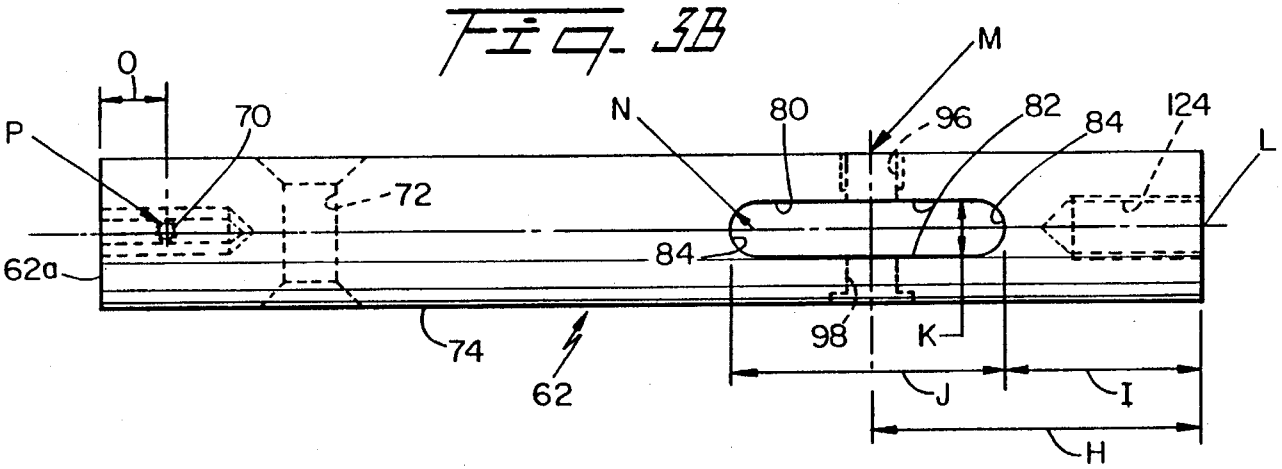
FIG. 3B is a top elevational view of the horizontal connecting shaft.
Figure 3A:
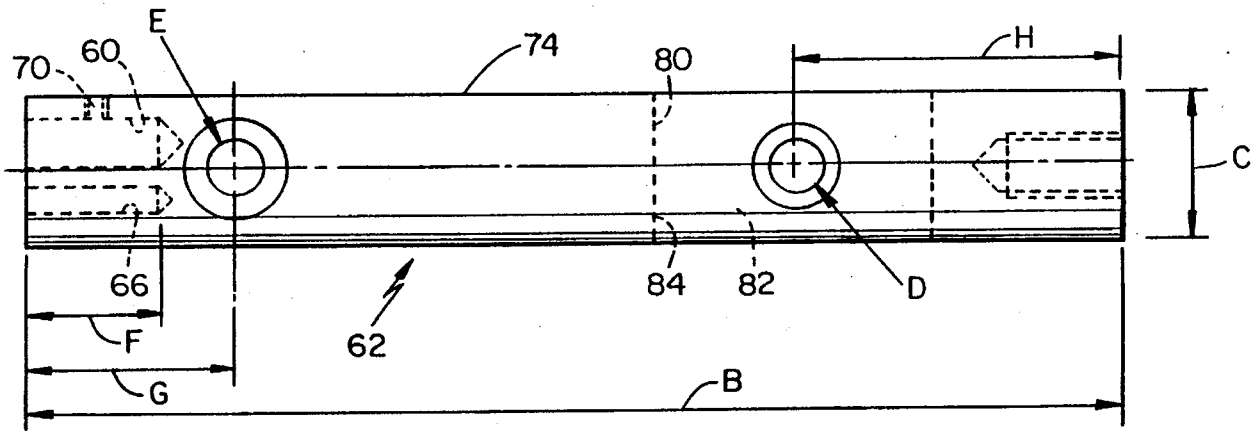
FIG. 3A is a side elevational view of the horizontal connecting shaft.
Figure 3C:
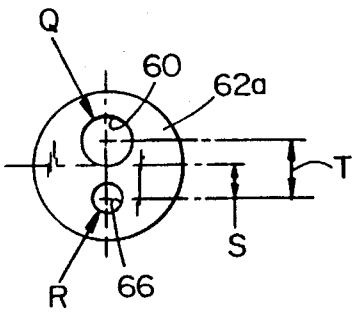
FIG. 3C is a rear end elevational view of the horizontal connecting shaft.
Figure 3D:
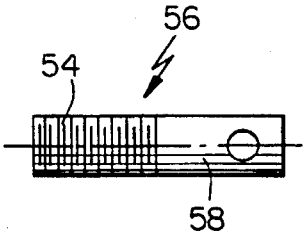
FIG. 3D is a side elevational view of one of the connecting pins for securing the shaft to the riser.
Figure 3E:
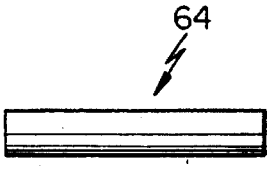
FIG. 3E is a sectional view of another of the connecting pins for securing the shaft to the riser.

FIGS. 3A, 3B and 3C are side, top and rear end elevational views of the horizontal connecting shaft 62, respectively. The dimensions (in inches) of this shaft 62 of the preferred embodiment are preferably as set forth hereinbelow:

| | |
|---|---|
| A | Shaft material is 2011 Aluminum 0.875" diameter |
| B | 6.500 |
| C | 0.875 diameter |
| D | 0.312 diameter - this side only 0.500 counter-bore 0.125 deep |
| E | 0.312 diameter thru 0.625 diameter × 45° counter-sink 2 places |
| F | 0.800 |
| G | 1.250 |
| H | 1.937 |
| I | 1.125 |
| J | 1.625 |
| K | 0.312 + 0.002 − 0.000 slot thru |
| L | 0.312 × 24 UNF threads 0.750 deep |
| M | 0.312 × 24 UNF threads this side only |
| N | 0.156 radius |
| O | 0.375 |
| P | 10-32 UNF threads thru |
| Q | 0.3125 diameter |
| R | 0.187 diameter ± 0.002 |
| S | 0.180 |
| T | 0.320 |

As depicted in FIG. 3A, the horizontal connecting shaft 62 is preferably of constant diameter along its entire length. The rear end (FIG. 3C) of this shaft 62 (left side of FIGS. 3A and 3B) are formed with the unthreaded vertically spaced blind bores 60,66 each of which extends parallel to the central longitudinal axis of the shaft. A vertically extending tapped through bore 70 formed in the top side of the rear end of the shaft 62 intersects the larger diameter or upper bore 60 to enable a set screw (not shown) to bear down against the first pin 56 to provide a locked connection preventing the shaft 62 from slipping off of the first and second pins 56,64.

A transversely extending horizontal through bore 72 is formed forwardly adjacent and at right angles to the first and second rear blind bores 60,66. Preferably, each opposite end of this transverse through bore 72 is formed with a 45° countersink which extends outwardly from the through bore to intersect the cylindrical side surface 74 of the shaft 62. A flexible strap 76 formed with a buckle at one end thereof is adapted to extend through this transverse bore 72 to be wrapped around the lower portion 44 of the riser section located below the intermediate hand grip portion 36 with the loose strap end received in the buckle after being tightly wrapped around the riser section. The purpose of the strap 76 is to apply to the shaft 62 a rearwardly directed force in the direction of the riser section 44 to ensure that the shaft and the connecting pins 56,64 are tightly urged against the riser section 44. This will prevent slippage of the shaft 62 from the pins 56,64 and thereby prevent relative rotation between the shaft longitudinal axis and the riser section forward edge 46. However, it will be understood that the connecting arm assembly may be fixed to the riser with only the threaded pin 56 and the strap 76 although, in practice, the non-rotatable connection is more effectively obtained with the two pins 56,64.

A vertically extending through slot 80 is formed in a front portion of the cylindrical shaft 62. The through slot 80 is defined by a pair of vertical parallel elongate side walls 82 extending in the longitudinal direction of the shaft 62 which are delimited with a pair of vertically extending curved end walls 84 at the front and rear ends of the slot 80. The slot 80 receives the upper end of the support rod assembly 18 which is in the form of a pivotal connecting link 86 (FIG. 4A) that is pinned within this mounting slot 80 to provide a pivotal connection between the shaft 62 and the quick release coupler on top of support rod 18 to enable adjustment of the angle between the shaft and bar to suit the requirements of the archer 22. More specifically, with reference to FIGS. 4A and 4B, this link 86 comprises a vertically extending mounting ear 88 having parallel wide faces 90 defining a thickness slightly less than the slot width. A smooth through bore 92 extends between these faces 90 for alignment with the transverse through bore 80 formed in the shaft 62 through which a threaded pivot pin extends. As best depicted in FIGS. 3B, one end of the transverse through bore 80 in the shaft 62 is threaded as at 96 to provide a threaded connection with the pivot pin 94. The other through bore portion 98 is smooth and provided with a countersink to receive and capture a portion of the screw head of the pivot pin. Optionally, this screw head may be formed with a hexagonal recess to allow for use of an Allen wrench.

Figure 4A:
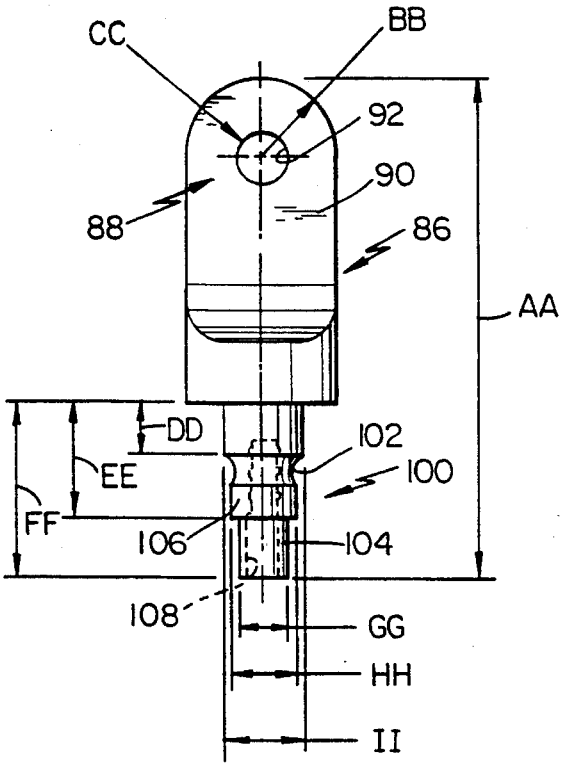
FIG. 4A is a side elevational view of a pivot connection between the connecting shaft and the support rod assembly.
Figure 7:
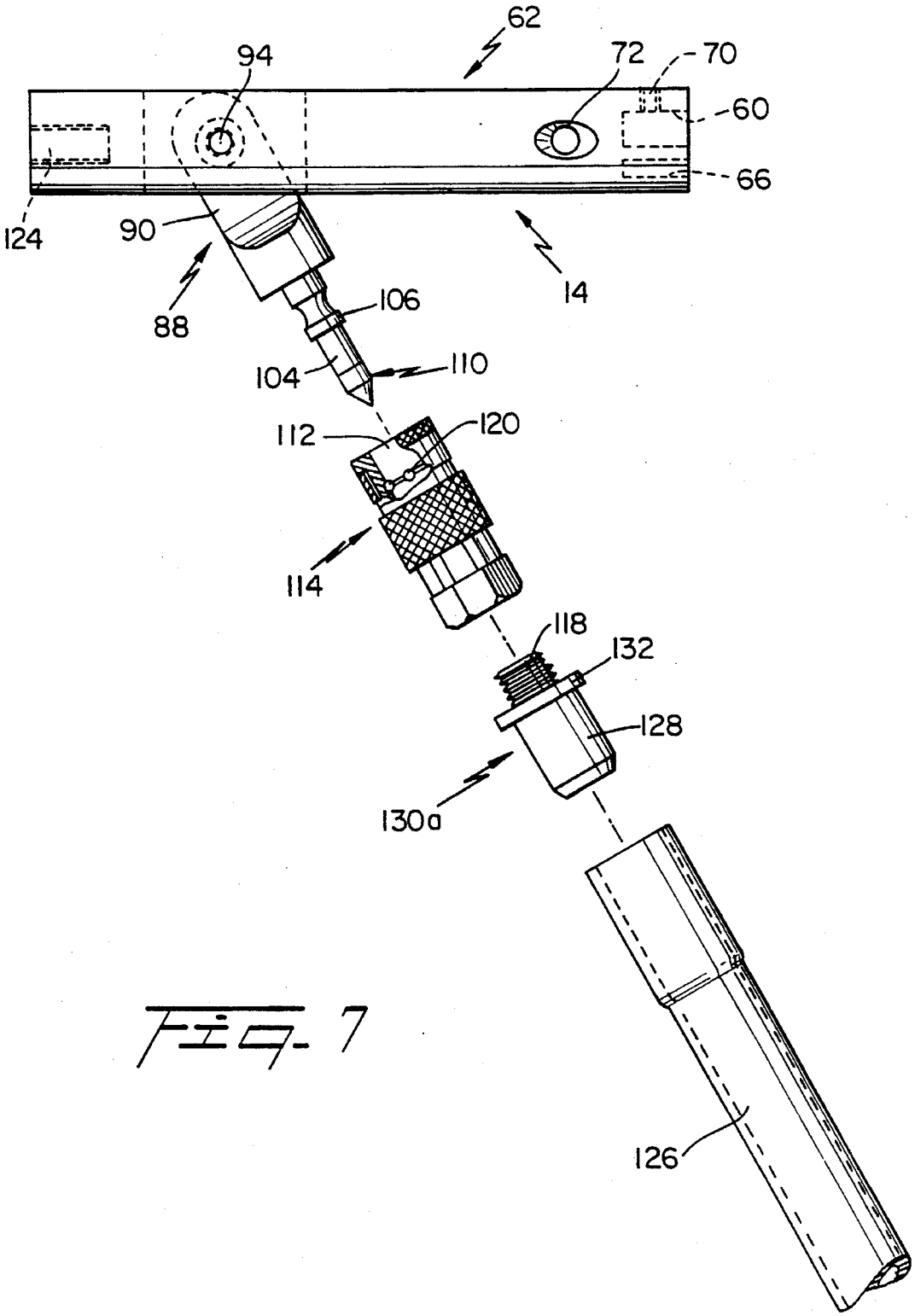
FIG. 7 is an exploded side view of the bow connecting arm and support rod assembly.

Referring to FIG. 4A, the lower end 100 of the pivot link 86 is formed with an annular groove 102 below which projects a small diameter elongate stub shaft 104 separated from the groove with a larger diameter land 106. This stub shaft 104 may be provided with a threaded vertical blind bore 108 adapted to receive a threaded portion 109 of a pointed end 110. In operation, the pointed end 110 attached to the stub shaft 104 is inserted into the upper axial bore 112 of a coupler member 114 such as a "T" style Milton Kwik Change® coupler (see FIG. 7) having an axial threaded blind bore (not shown) in the lower end thereof which is adapted to receive the threaded upper end 118 of the support rod assembly. The pointed end 110 of the pivot link 86 is inserted into the upper axial bore until a plurality of circumferentially spaced ball bearings 120 disposed in the coupler lockingly engage within the annular retaining groove 102 to provide a quick disconnect between the coupler and the pivot link. The upper flat, rounded end of the pivot link is then inserted into the slot 80 in the horizontal shaft 62 for pinned connection in the aforesaid manner. Alternatively, the point 110, often referred to as a hunter's point, can be used without the support rod assembly, such as by resting the pointed end 110 on a convenient fence post, a tree limb of the right height, or a ledge in a blind or a tree stand.

Figure 4B:
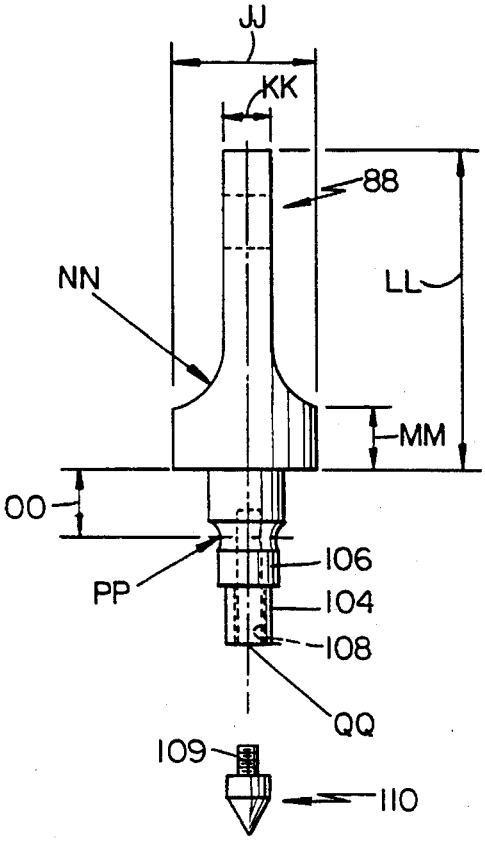
FIG. 4B is a front elevational view of the pivot connection of FIG. 4A.

Exemplary dimensions (in inches) for the manufacture of the pivot link (preferably made of 2011 aluminum) depicted in FIGS. 4A, 4B may be as follows:

| | |
|---|---|
| AA | 2.850 |
| BB | 0.437 radius |
| CC | 0.312 hole thru |
| DD | 0.300 |
| EE | 0.650 |
| FF | 1.000 |
| GG | 0.312 diameter |
| HH | 0.430 diameter + 0.000 − 0.001 |
| II | 0.453 diameter + 0.000 − 0.003 |
| JJ | 0.875 diameter |
| KK | 0.312 + 0.000 − 0.003 |
| LL | 1.850 |
| MM | 0.350 |
| NN | 0.375 radius |
| OO | 0.390 + 0.001 − 0.001 |
| PP | 0.93 radius to 0.320 diameter at centerline |

-continued

| | |
|---|---|
| QQ | "A" Number 29 drill 0.800 deep - number 7 drill 0.400 deep 8-32 UNF threads 0.400 deep |

As mentioned hereinabove, the front end of the horizontal connecting shaft 62 is formed with a threaded axial blind bore 124 (see FIG. 7) preferably having the same thread pitch and dimensions of the threaded blind bore 52 formed in the riser section of the bow. This allows for attachment of a game tracker and other auxiliary equipment to the bow through the horizontal shaft 62.

Figure 5:
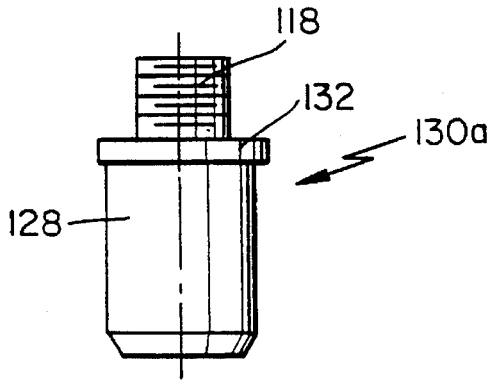
FIG. 5 is a side elevational view of a connecting member disposed in the upper end of the support rod assembly.

The support rod assembly 18 preferably includes a pair of upper and lower rods 126 and 128 which are telescopically connected to each other with a locking ring 130 which may be tightened to "lock" the rods together once they have been extended to a desired length. The upper end of the upper support rod 126 is formed with an axial opening adapted to receive a smooth wall cylindrical lower section 128 of a connecting member 130*a* depicted in FIG. 5. This connecting member 130*a* preferably has a larger diameter annular support flange 132 adapted to be supported on the annular upward facing edge of the upper support rod. The small diameter threaded portion 118 projects upwardly from the flange 132 for threaded engagement with the axial threaded bore in the lower end of the quick connect coupling.

The rubber cap 24 is preferably fitted onto the lower end of the lower support rod 128 to provide frictional contact between the support rod assembly and a surface (e.g., the top of the archer's shoe) upon which the support rod assembly rests. Other types of connecting means may also be used, such as a cup attachable to the archer's shoe with straps or other fastening means, wherein the cup defines an upwardly directed cylindrical recess adapted to receive the lower end of the support rod assembly. Other types of telescopic as well as non-telescopic poles may be used to define the support rod assembly. Although it is desirable to provide some form of telescopic or collapsible arrangement to adjust the effective length of the support rod assembly, it is also within the scope of this invention to utilize a support rod of fixed length in combination with the horizontal connecting shaft of the present invention.

Figure 6A:
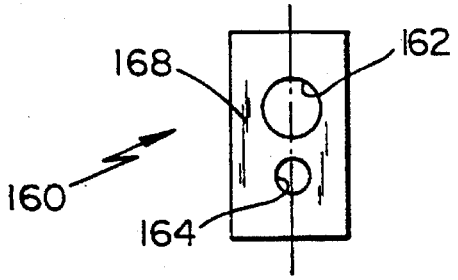
FIG. 6A is a front elevational view of a drill block used as part of a conversion kit in accordance with the invention.
Figure 6C:
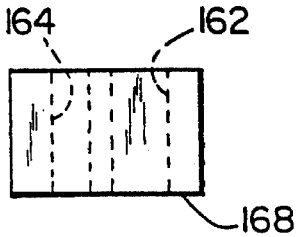
FIG. 6C is a side elevational view of the drill block of FIGS. 6A, 6B.
Figure 6B:
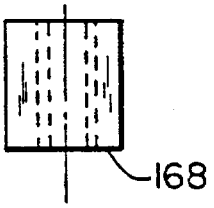
FIG. 6B is a top elevational view of the drill block of FIG. 6A.

As mentioned above, a conventional bow is typically formed with a riser section formed with only a single threaded blind bore 52 in a forward facing edge 46 of the riser section at a particular location thereon. Although it is within the scope of this invention to secure the rear end of the horizontal connecting shaft 62 to this threaded bore 52 only with a single first pin 56, the use of a second pinned connection 64 is highly desirable and important to minimize rotation between the riser section 44 and the shaft 62. This rotation is likely to occur in view of the high degree of rotational torque occurring at the interface between the shaft rear end with the riser section, considering that the support rod assembly acts as a moment arm relative to the lower support point at ground level (i.e., the archer's shoe). Therefore, to enable use of the horizontal connecting shaft 62 of this invention with a conventional bow, it is necessary to retrofit the riser section 44 by forming the second blind bore 68 vertically below the threaded blind bore 52 and spaced therefrom by approximately the dimension T in FIG. 3C. To that end, a conversion kit may comprise a drill block 160 (FIGS. 6A–6C) formed with a large diameter upper through bore 162 and a smaller diameter lower through bore 164 vertically spaced from and parallel to the upper through bore.

In operation, a hex-head bolt (not shown) is inserted through the untapped upper through bore 162 so that the threaded end thereof projects from the rear face 168 of the guide drill block 160. This threaded end is then threadedly received in the conventionally formed threaded blind bore 52 in the riser section 44 until the rear face 168 of the block abuts tightly against the flat cylindrical face 50 surrounding the blind bore 52. The block 160 is then tightened securely against the riser section 44 with an Allen wrench. Next, a drill bit (not shown) corresponding in diameter to that of the second pin 64 is inserted through the smaller diameter untapped through bore 164 in the guide block 160 and is thereby used to drill the second blind bore 68 in the riser section 44 a precise distance T ±0.03". The drill bit may form a part of the kit and may be pre-marked so that the second blind bore 68 is drilled to a desired depth. After the desired depth is achieved, the drill and then the hex-head bolt 166 are removed to detach the drill block 160 from the handle section 44. In this manner, the second blind bore 68 is formed in precise location beneath the first blind bore 52.

The larger diameter first pin 56 is then threaded into the stabilizer port or first blind bore 52 in the riser section 44 so that the unthreaded portion 58 projects forwardly from the riser front surface 46. The smaller diameter smooth walled second pin 64 is then inserted into the smaller diameter second blind bore 68 in the handle section 44. The rear end 62*a* of the horizontal connecting shaft 62 is then mounted to the smooth walled sections of the protruding front ends of the first and second pins 56,64 until the rear face of the shaft abuts against the front face 50 of the riser section 44. A set screw (not shown) may then be received in the lower bore 70 (or the upper bore) of the shaft 62 to lockingly engage the second pin 64 (or the first pin). The strap is then wrapped tightly around the riser section 44 and the excess strap material is inserted through the buckle and securely tightened. The lower end 110 of the pivot link 86 is then inserted into the upper end of the quick connect coupling to pivotally connect the horizontal connecting shaft 62 to the support rod assembly 18. The support rods 126,128 are then adjusted to a desired effective length and locked together with the locking system 130, as aforesaid. The bow arm support stabilizer system 10 of the invention is now ready for use.

As mentioned above, it is also within the scope of this invention to secure the shaft 62 to the bow handle by means of the pin 56.

Although the use of first and second blind bores 50,68 in the riser section 44 for non-rotationally securing the horizontal connecting shaft 62 to the bow 16 represents the preferred embodiment of this invention, other forms of non-rotational attachment are possible. For example, it is possible to use the threaded pin 56 in conjunction with a recess section in the bow riser which may be adapted to accept the rear end of the shaft. In this case, the shaft essentially functions as a key and the recessed section of the bow riser has a keyway. It is also possible to form the rear end of the shaft so as to have a non-cylindrical cross section adapted to be received in a corresponding recessed section in the riser.

Still other methods of attaching the rear end of the horizontal connecting shaft to the bow riser section may be utilized within this invention. Instead of a plurality of stabilizer holes 52,68, as aforesaid, some type of keying system (e.g., tongue and groove, splint, key and keyway, etc.) between the rear end of the horizontal connecting shaft and the front edge of the handle section may be utilized.

Numerous other advantages result from use of the bow arm support stabilizer system 10 of this invention. For example, the most obvious and primary use of the system is to support most or all of the weight of the bow to eliminate quivering while aiming and thereby allow for significant improvement of one's score on a target range, or during hunting. Since there are tournament rules that restrict the bow from contacting the ground, the support rod assembly 18 resting on top of the archer's shoe 26 in the aforesaid manner will potentially allow the use of this invention during tournament shooting. The system can also be used as a training aid while learning to use a bow and it is also easier to hold the bow with an open hand with this system which eliminates torque and twisting of the bow while shooting. The system also allows for sighting the bow, and can be used for tuning a bow, to check arrow accuracy, and as an aid to handicapped archers.

While there has been described and illustrated one specific embodiment of the invention, it will be clear that variations in the details of the embodiments specifically illustrated and described may be made without departing from the true spirit and scope of the invention as defined in the appended claims.

I claim:

1. A bow arm support stabilizer system in combination with an archer's bow for supporting the archer's bow relative to a support point, comprising:

a. a bow connecting arm assembly non-rotatably connected to project forwardly from a riser section of the bow, wherein said bow connecting arm assembly includes a connecting shaft having a keyed connection at a rear end thereof to provide for keyed attachment to the riser section; and b. a support rod assembly connected to project downwardly from the bow connecting arm assembly so that a lower end of said support rod assembly is engageable with said support point;

whereby longitudinal axes of said bow, said connecting shaft, and said support rod assembly lie along substantially same plane, whereby said connecting arm assembly and support rod assembly transfers the weight of the bow to the support point so that the archer's support arm does not have to support the bow's weight during aiming and shooting.

2. The combination of claim 1, wherein said support rod assembly includes a pivot link secured to the connecting shaft.

3. The combination of claim 1, wherein said connecting arm assembly is formed with a threaded bore in a forward end thereof which is adapted to receive a game tracker or other attachments in threaded engagement therewith.

4. The combination of claim 1, wherein said support rod assembly includes at least a pair of rods telescopically connected to each other.

5. The combination of claim 4, further comprising a locking system for locking said rods together to thereby define an effective length of said support rod assembly.

6. The combination of claim 4, further comprising a rubber cap mounted to the lower end of the support rod assembly.

7. A bow arm stabilizer system in combination with an archer's bow for supporting the archer's bow relative to a support point external to the archer, comprising:

a. a bow connecting arm assembly connected to project forwardly from a riser section of the bow, said bow connecting arm assembly including a connecting shaft secured at a rear end thereof to the riser section; and b. a support rod assembly connected to project downwardly from the bow connecting arm assembly so that a lower end of said support rod assembly is engageable with said external support point;

wherein said connecting shaft is secured to the riser section with at least two pins which thereby prevent relative rotation between the shaft and the riser section to prevent twisting of the bow about the longitudinal axis of the connecting shaft during aiming and shooting; and whereby said connecting arm assembly and support rod assembly transfers the weight of the bow to the external support point so that the archer's support arm does not have to support the bow's weight during aiming and shooting.

8. The combination of claim 7, further comprising a strap and a locking buckle engageable with the shaft and the bow, said strap being wrapped about the riser section to impart a tightening force urging the shaft towards the riser section to hold the shaft on the bow.

9. The combination of claim 7, wherein a rear end face of the shaft is formed with a pair of bores respectively receiving forwardly projecting ends of said pins.

10. The combination of claim 9, wherein said pins are of different diameter.

11. The combination of claim 10, wherein the larger diameter pin has a threaded end received in a threaded bore in the riser section.

12. The combination of claim 11, wherein the threaded bore formed in the riser section intersects a substantially circular flat face formed in a forward facing edge of the riser section and below an intermediate hand grip portion thereof.

13. The combination of claim 11, wherein the smaller diameter pin is unthreaded and smooth along substantially its entire length.

14. The combination of claim 7, wherein the shaft includes a transverse through bore, and further comprising a strap with a locking buckle engageable with the shaft through the transverse through bore, said strap being further engageable with the bow by being wrapped around the riser section to impart a tightening force urging the shaft toward the riser section.

15. The combination of claim 7, wherein said shaft includes a vertically extending through slot extending longitudinally through a forward portion of the shaft, and further comprising a pivot link pinned to the shaft within the slot, said support rod assembly being attached to the pivot link.

16. The combination of claim 7, wherein said connecting arm assembly is formed with a threaded bore in a forward end thereof which is adapted to receive a game tracker in threaded engagement therewith.

17. A bow arm support stabilizer system in combination with an archer's bow for supporting the archer's bow relative to a support point external to the archer, comprising:

a. a bow connecting arm assembly connected to project forwardly from a riser section of the bow; and b. a support rod assembly connected to project downwardly from the bow connecting arm assembly so that a lower end of said support rod assembly is engageable with said external support point;

wherein longitudinal axes of said bow, said bow connecting arm assembly, and said support rod assembly lie along substantially same plane and wherein said connecting arm assembly includes a connecting shaft having a keyed connection at a rear end thereof to provide keyed attachment to the riser section to resist rotation of the connecting arm assembly about its longitudinal axis and relative to the riser.

18. A method for supporting an archer's bow during use, comprising the steps of:

a. attaching a bow connecting arm assembly to a bow riser through a keyed connection between said assembly and said riser so that the assembly projects forwardly from the bow;

b. connecting a support rod assembly so that longitudinal axes of said bow, said bow connecting arm assembly, and said support rod assembly lie along substantially same plane and so that said rod assembly projects downwardly from the bow to engage a support surface at a lower end thereof; and c. extending the archer's bow arm during aiming and shooting with the weight of the bow being supported by the support rod assembly engaging said support surface.

19. A bow arm support stabilizer system in combination with an archer's bow for supporting the standing adult archer's bow relative to a support point external to the archer at ground level, comprising:

a. a bow connecting arm assembly including a connecting shaft having a keyed connection at a rear end thereof to provide for keyed attachment to a riser section of the bow; and b. a support rod assembly connected to project downwardly from the bow connecting arm assembly so that a lower end of said support rod assembly is engageable with said external support point;

whereby longitudinal axes of said bow, said connecting shaft, and said support rod assembly lie along substantially same plane, whereby said connecting arm assembly and support rod assembly transfers the weight of the bow to the external support point so that the archer's support arm does not have to support the bow's weight during aiming and shooting.

* * * * *